US008079831B2

(12) United States Patent
Stoddard

(10) Patent No.: US 8,079,831 B2
(45) Date of Patent: Dec. 20, 2011

(54) SUBMERSIBLE PUMP HAVING A TWO-STEP CONTROL HYDRAULIC VALVE

(75) Inventor: Kenneth John Stoddard, Santaquin, UT (US)

(73) Assignee: Smith International, Inc., Houston, TX (US)

( * ) Notice: Subject to any disclaimer, the term of this patent is extended or adjusted under 35 U.S.C. 154(b) by 421 days.

(21) Appl. No.: 12/431,140

(22) Filed: Apr. 28, 2009

(65) Prior Publication Data

US 2010/0272587 A1 Oct. 28, 2010

(51) Int. Cl.
*F04B 47/08* (2006.01)
*F01B 7/18* (2006.01)

(52) U.S. Cl. ..... 417/375; 91/235; 91/313

(58) Field of Classification Search ..... 417/375, 417/394, 555.2; 91/235, 313
See application file for complete search history.

(56) References Cited

U.S. PATENT DOCUMENTS

| | | | | |
|---|---|---|---|---|
| 4,649,956 | A | 3/1987 | Zeuner et al. | |
| 5,893,707 | A * | 4/1999 | Simmons et al. | 417/393 |
| 6,889,765 | B1 | 5/2005 | Traylor | |
| 7,252,148 | B2 | 8/2007 | Traylor | |
| 2004/0188096 | A1 | 9/2004 | Traylor | |
| 2005/0142005 | A1 | 6/2005 | Traylor | |
| 2006/0008364 | A1 | 1/2006 | Traylor | |
| 2007/0110597 | A1 | 5/2007 | Traylor | |
| 2008/0003118 | A1 | 1/2008 | Traylor | |
| 2011/0030547 | A1 * | 2/2011 | Depiak et al. | 91/51 |

* cited by examiner

*Primary Examiner* — Karabi Guharay
*Assistant Examiner* — Michael Santonocito
(74) *Attorney, Agent, or Firm* — Kevin McGoff

(57) ABSTRACT

A submersible pump includes a pump valve configured to switch the pump between first and second states in which a piston is respectively extended and retracted. The pump valve includes first and second components that reciprocate between corresponding first and second positions. The pump is in the first state when both components are in their corresponding first position. The pump is in the second state when both components are in their corresponding second position. Neither the valve nor the pump is hydraulically locked at any time during normal operation.

19 Claims, 10 Drawing Sheets

SUBMERSIBLE PUMP HAVING A TWO-STEP CONTROL HYDRAULIC VALVE

FIELD OF THE INVENTION

The present invention relates generally to downhole submersible pumping systems. More particularly, the invention relates to a method and apparatus for controlling a hydraulically actuated submersible pump used in artificial lift applications in hydrocarbon producing wells.

BACKGROUND OF THE INVENTION

Hydrocarbons, and other fluids, are often contained within subterranean formations at elevated pressures. Wells drilled into these formations allow the elevated pressure within the formation to force the fluids to the surface. However, in low pressure formations, or when the formation pressure has diminished, the formation pressure may be insufficient to force the fluids to the surface. In these cases, a pump may be installed to provide the required pressure to produce the fluids.

The volume of well fluids produced from a low pressure well is often limited, thus limiting the potential income generated by the well. For wells that require pumping systems, the installation and operating costs of these systems often determine whether a pumping system is installed to enable production or the well is abandoned. Among the more significant costs associated with pumping systems are the costs for installing, maintaining, and powering the system. Reducing these costs may allow more wells to be produced economically and increase the efficiency of wells already having pumping systems.

In recent years, the deployment of small diameter pumps in the production tubing has often provided for economic recovery of well bore fluids. One example of such a small diameter pump is disclosed in commonly assigned U.S. Pat. No. 7,252,148. Commercially available small diameter pumps are commonly powered via hydraulic actuation and are therefore connected to the surface via one or more hydraulic lines. For example, the hydraulic actuation may be configured to drive a piston in the diaphragm chamber of a diaphragm pump. Reciprocation of the piston is commonly accomplished via a switching mechanism having first and second states. In the first state, the fluid porting is such that the piston is extended. In the second state, the fluid porting is changed so as to cause retraction of the piston. One such switching mechanism is disclosed in commonly assigned, co-pending U.S. Patent Publication 2008/0003118.

While hydraulically actuated submersible pumps have been commercially utilized, they have been known on occasion to become hydraulically locked in service. Such hydraulic locking sometimes results in the need to remove the pump from the wellbore. Therefore, a need remains for an improved hydraulically actuated semisubmersible pump.

SUMMARY OF THE INVENTION

The present invention addresses one or more of the above-described drawbacks of the prior art. One aspect of the invention includes a hydraulically actuated pump including a two-stage pump valve configured to switch the pump between first and second states in which a piston is respectively extended and retracted. The pump valve includes first and second components that reciprocate between corresponding first and second positions (e.g., first and second axially opposed positions). In one exemplary embodiment, the first component is moved from a first position to a second position (e.g., via movement of the piston at the end of its stroke). Movement of the first component to the second position then enables the second component to be hydraulically driven from its first position to its second position thereby switching the pump valve to the second state which causes the piston to be hydraulically driven in the other direction. The process is reversed when the piston reaches the end of its stroke with the first component being moved back to its first position. Movement of the first component back to its first position then enables the second component to be hydraulically driven back to its first position thereby switching the pump valve back to the first state.

Exemplary embodiments of the present invention advantageously provide several technical advantages. For example, the present invention tends to improve the reliability of submersible pumps deployed in subterranean wellbores. The invention is particularly advantageous in that neither the valve nor the pump is hydraulically locked at any time. Full system pressure is intended to always be available for driving the valve between states.

In one aspect the present invention includes a hydraulically actuated submersible pump. The pump includes a pump body and a piston configured to reciprocate between extended and retracted axial positions relative to the pump body. A pump valve is deployed in the pump body in fluid communication with a fluid supply. The pump valve has first and second states, the first state supplying fluid operable to move to the piston to the extended position and the second state supplying fluid operable to move the piston to the retracted position. The pump valve includes first and second components configured to move between corresponding first and second positions in the pump body. The pump valve is in the first state when the first and second components are in their corresponding first positions and in the second state when the first and second components are in their corresponding second positions.

In another aspect, the present invention includes a hydraulically actuated submersible pump. The pump includes a pump body and a piston configured to reciprocate between extended and retracted axial positions relative to the pump body. A pilot spool is deployed in the pump body and is configured to be hydraulically actuated between corresponding first and second axial positions with respect to the pump body. A main spool is deployed in the pump body and is also configured to be hydraulically actuated between corresponding first and second axial positions with respect to the pump body. A fluid supply port is in fluid communication with the piston. The supplied fluid is operable to extend the piston when the pilot spool and the main spool are in their corresponding first axial positions and to retract the piston when the pilot spool and the main spool are in their corresponding second axial positions.

In still another aspect, the present invention includes a hydraulically actuated submersible pump. The pump includes a pump body and a piston configured to reciprocate between extended and retracted axial positions relative to the pump body. A pilot spool is deployed in the pump body and configured to move between first and second axial positions with respect to the pump body. An upper stop is mechanically coupled with the pilot spool such that retraction of the piston to its retracted position engages the upper stop and moves the pilot spool to its first position. A lower stop is mechanically coupled with the pilot spool such that extension of the piston to its extended position engages the lower stop and moves the pilot spool to its second position. A main spool is deployed radially between and substantially coaxial with the pump body and the pilot spool. The main spool is configured to be hydraulically actuated between first and second axial positions with respect to the pump body such that the main spool is hydraulically urged towards its first position when the pilot spool is in its first position and the main spool is hydraulically urged towards its second position when the pilot spool is in its second position. A fluid supply port is in fluid communication with the piston. The supplied fluid is operable to extend the piston when the pilot spool and the main spool are in their corresponding first axial positions and to retract the piston when the pilot spool and the main spool are in their corresponding second axial positions.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and the specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION

Figure 1A:
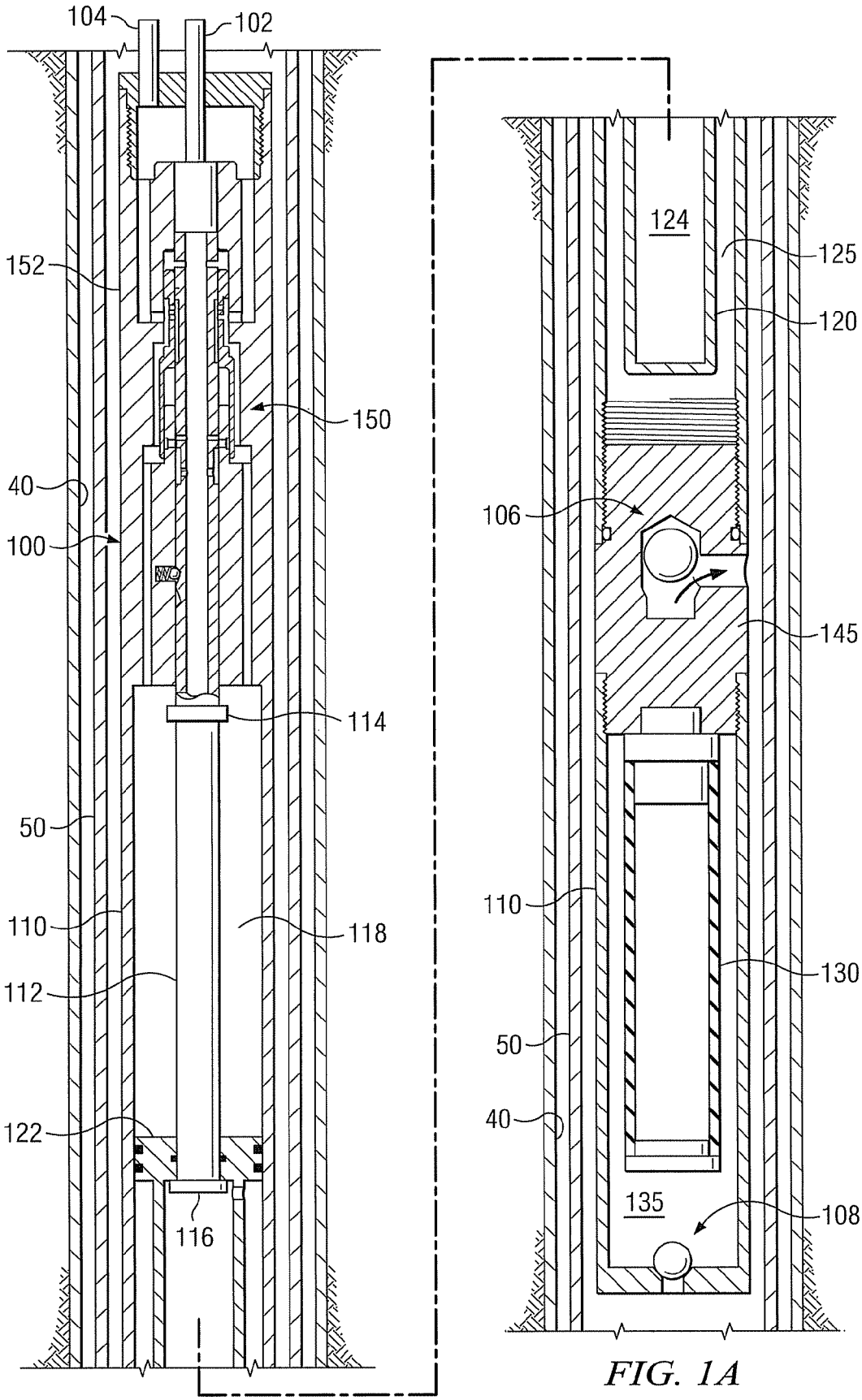
FIGS. 1A and 1B depict, in longitudinal cross-section, an exemplary submersible pump assembly in accordance with the present invention with a piston in extended and retracted positions.

Referring to FIGS. 1A through 2H, exemplary embodiments of the present invention are depicted. With respect to FIGS. 1A through 2H, it will be understood that features or aspects of the embodiments illustrated may be shown from various views. Where such features or aspects are common to particular views, they are labeled using the same reference numeral. Thus, a feature or aspect labeled with a particular reference numeral on one view in FIGS. 1A through 2H may be described herein with respect to that reference numeral shown on other views.

Figure 1B:
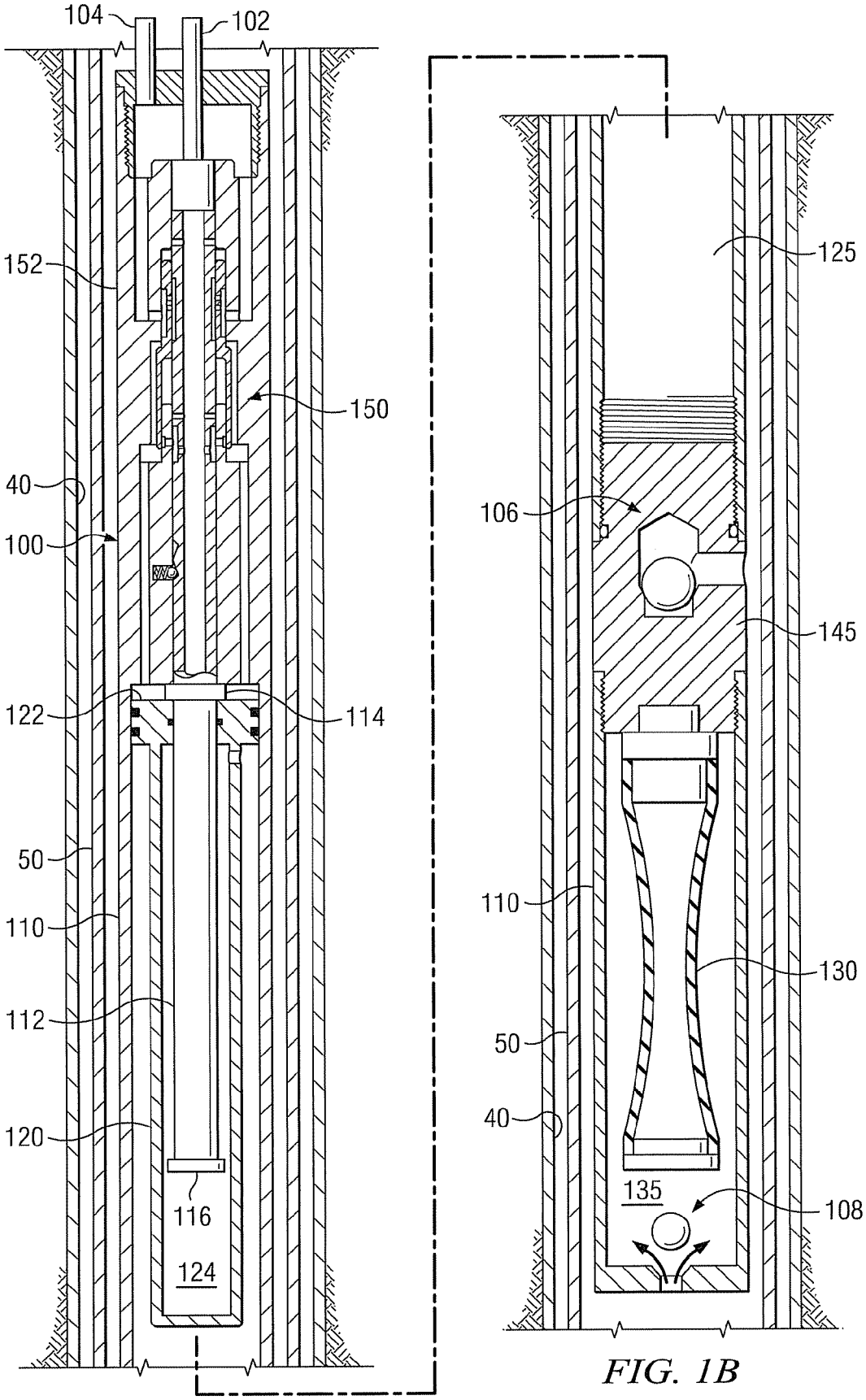

Referring first to FIGS. 1A and 1B (collectively FIG. 1), one exemplary embodiment of a hydraulically actuated pump assembly 100 in accordance with the present invention is shown deployed in production tubing 50 deployed in cased wellbore 40. Pump assembly 100 comprises a piston 120 configured to reciprocate in pump body 110. FIGS. 1A and 1B depict the piston 120 in the fully extended and fully retracted positions. In the exemplary embodiment shown, piston 120 is deployed within a working chamber 125 that is isolated from the wellbore fluids in pump chamber 135. Extension of the piston 120 forces fluid in working chamber 125 down through crossover network 145 into diaphragm 130, thereby expanding the diaphragm 130. As the piston 120 extends (and diaphragm 130 expands), the pressure within pump chamber 135 increases, which forces wellbore fluids up through crossover network 145, through outlet valve 106, and up through the production tubing 50 to the surface. As the piston 120 retracts into pump body 110, the fluid is drawn out of the diaphragm 130, up through crossover network 145, and into working chamber 125. This causes inlet valve 108 to open which draws wellbore fluid into the pump chamber 135. Wellbore fluids are thereby pumped upward towards the surface through production tubing 50 by reciprocating the piston 120 between its extended and retracted positions.

In the exemplary embodiment shown, piston 120 is a substantially hollow tube-like member including a flange 122 that is disposed about center feed 112 between upper stop 114 and lower stop 116. The outer edge of flange 122 is sealingly engaged with the inner surface of the pump body 110 and the inner edge of the flange is sealingly engaged with an outer surface of center feed 112. The sealing engagement of the flange 122 isolates fluid within housing chamber 118 from fluid within piston chamber 124.

Pump assembly 110 further comprises a two-stage pump valve 150, which is described in more detail below with respect to FIGS. 2A-2H (collectively FIG. 2). Hydraulic fluid lines 102 and 104 provide pressurized fluid to the pump valve 150. In the exemplary embodiment shown, line 102 is a supply line while line 104 is a return line. Pump valve 150 is configured to enable hydraulic actuation of piston extension and retraction. When the valve 150 is in a first state (FIG. 2A), the supplied hydraulic fluid causes the piston 120 to extend. When the valve 150 is in a second state (FIG. 2E), the supplied hydraulic fluid causes the piston 120 to retract.

Commonly assigned, co-pending U.S. Patent Publication 2008/0003118 discloses a pump valve including a single valve spool that moves axially between first and second axially opposed positions. Movement of the valve spool from one axial position to the other switches the valve between first and second states that enable hydraulic actuation of piston extension and retraction. One aspect of the present invention is the realization that pumps having a single valve spool (as does the pump disclosed in the '118 Publication) become hydraulically locked when the valve spool is located at an intermediate position between its first and second positions. In this intermediate position, both the high pressure hydraulic port and the return port are closed. Since both ports are closed, there is no way to hydraulically actuate (or un-stick) the pump once it becomes locked.

The present invention advantageously utilizes a two-stage pump valve so as to eliminate hydraulic locking of the pump. Pump valves in accordance with the present invention include first and second components (preferably, but not necessarily, coaxial spools) that reciprocate between corresponding first and second positions. Actuation of the pump valve requires the movement of both components to their corresponding new (other) positions. In a preferred embodiment the first and second components are moved sequentially. In other words, the first component is moved from a first position to a second position (e.g., via movement of the piston at the end of its stroke). Movement of the first component to the second position then enables the second component to be actuated from its first position to its second position. The first and second components are preferably, but not necessarily, hydraulically actuated between first and second axial positions. Movement of the second component to its second position then switches the pump valve to its second state which causes the piston to be driven in the other direction. Neither the valve nor the pump are hydraulically locked at any time during this process as full system pressure is always available to drive the valve to the new state (or to extend or retract the piston). The invention therefore advantageously improves pump reliability.

With continued reference to FIG. 1, and further reference now to FIG. 2, the structure and function of one exemplary embodiment of pump valve 150 as deployed in pump 100 is described in more detail. As depicted, pump valve 150 includes a valve housing 152 deployed about a pilot spool 160 having a through bore 161. The pilot spool 160 is configured to reciprocate between first and second axially opposed positions in the valve housing 152 as described in more detail below. When the pilot spool 160 is in its first axial position detent ball 192 of detent mechanism 190 engages a first circumferential groove 167 in the outer surface of the pilot spool 160. When the pilot spool 160 is in the second axial position the detent ball 192 engages a second groove 168 in the outer surface of the pilot spool 160.

In the exemplary embodiment depicted, valve 150 also includes a sleeve-like main spool 170 deployed radially between and coaxial with the valve housing 152 and the pilot spool 160 (although the invention is not limited in regard to the relative radial and coaxial deployment of these components). The main spool 170 is deployed axially between first and second shoulders 180 and 185 formed on an inner surface of housing 152 and also is configured to reciprocate between first and second axially opposed positions in the valve housing 152. In an alternative embodiment, first and second shoulders 180 and 185 may be provided by corresponding sleeves deployed in the housing 152.

Figure 2A:
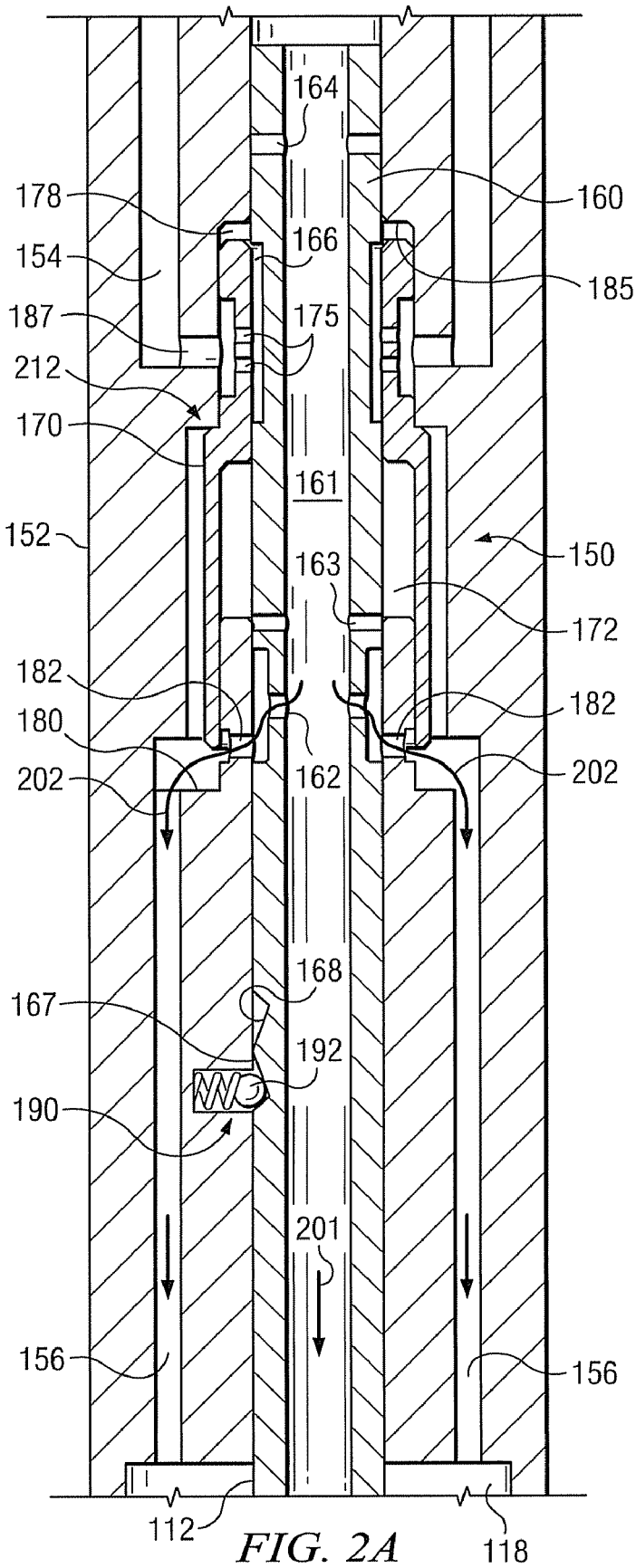
FIGS. 2A through 2H depict, in combination, actuation of an exemplary pump valve deployed in the pump depicted on FIGS. 1A and 1B.

With reference now to FIGS. 1A and 2A, pump valve 150 is depicted in a first state such that the high pressure hydraulic fluid causes extension of the piston 120. In the first state, the piston 120 is connected to high pressure hydraulic fluid via port 156 and is isolated from return port 154 (as depicted at 212). High-pressure fluid flows through bore 161 (as depicted at 201), through center feed 112, and into piston chamber 124. High pressure fluid also flows through ports 162 and 182, down through passageway 156, and into housing chamber 118 as indicated by arrow 202. Although hydraulic pressure is balanced across the flange 122, the high-pressure fluid within chambers 118 and 124 causes a pressure imbalance across piston 120 that extends the piston 120. In this first state, the piston 120 continues to extend (downward as depicted) until flange 122 contacts lower stop 116.

Figure 2B:
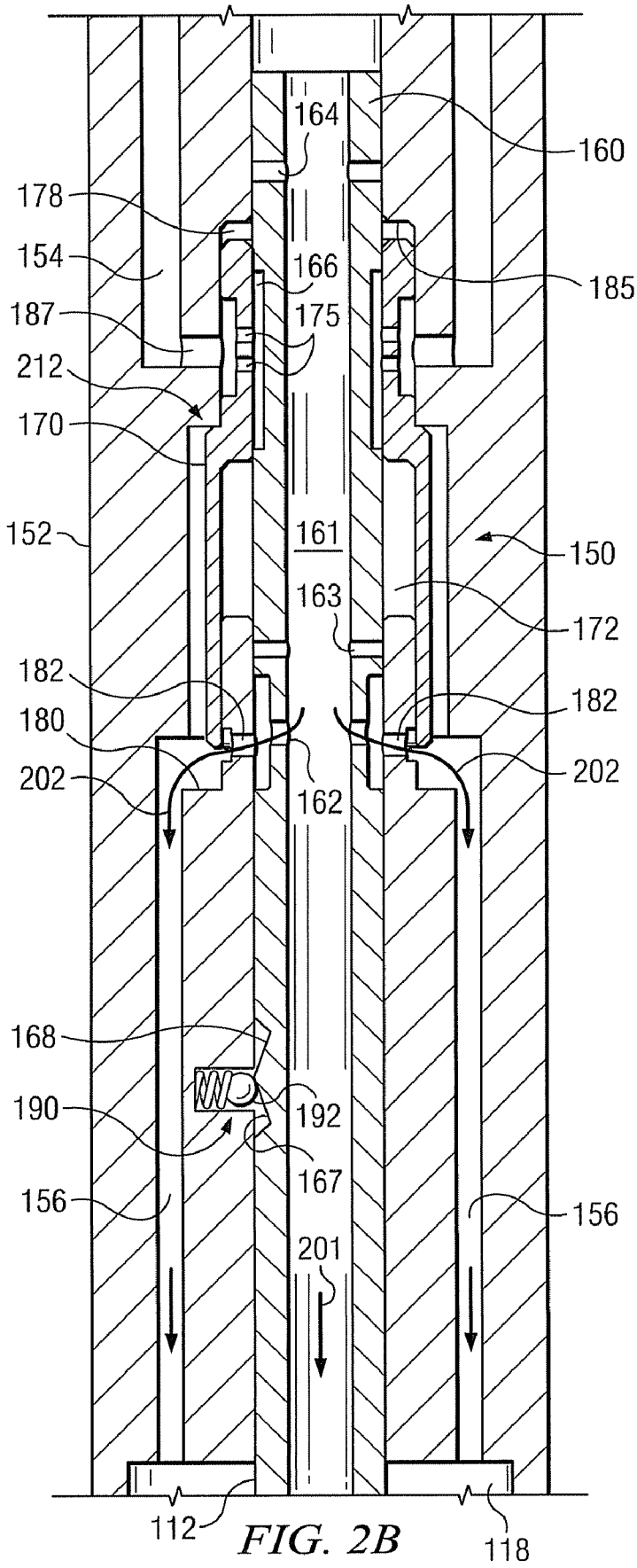

As flange 122 contacts lower stop 116, the extending movement of the piston 120 causes motion of the pilot spool 160 with the piston 120. Downward movement of the pilot spool 160 releases detent mechanism 190 thereby allowing the pilot spool to move with the piston 120. FIG. 2B depicts the pilot spool 160 in an intermediate state (axially located between its first and second positions) with the detent ball 192 between the first and second grooves 167 and 168. The pilot spool 160 continues to be hydraulically urged downward (with the piston 120) so that the detent ball 192 engages the second groove 168 as depicted on FIG. 2C. It will be understood that the invention is in no way limited to embodiments including a detent mechanism. Nor is the invention limited to the particular detent mechanism depicted. While detent mechanism 190 includes a radial spring, use of an axial spring may be preferred in certain small diameter tool embodiments.

Figure 2C:
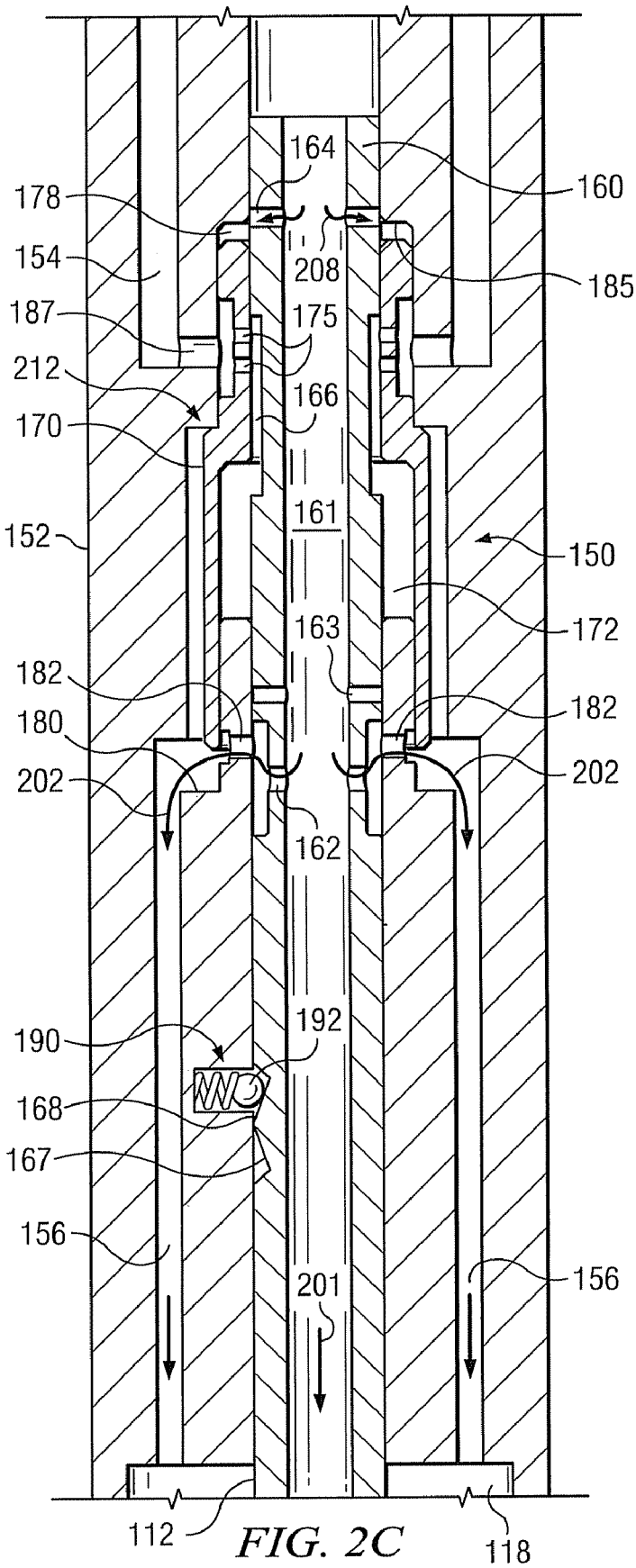
Figure 2D:
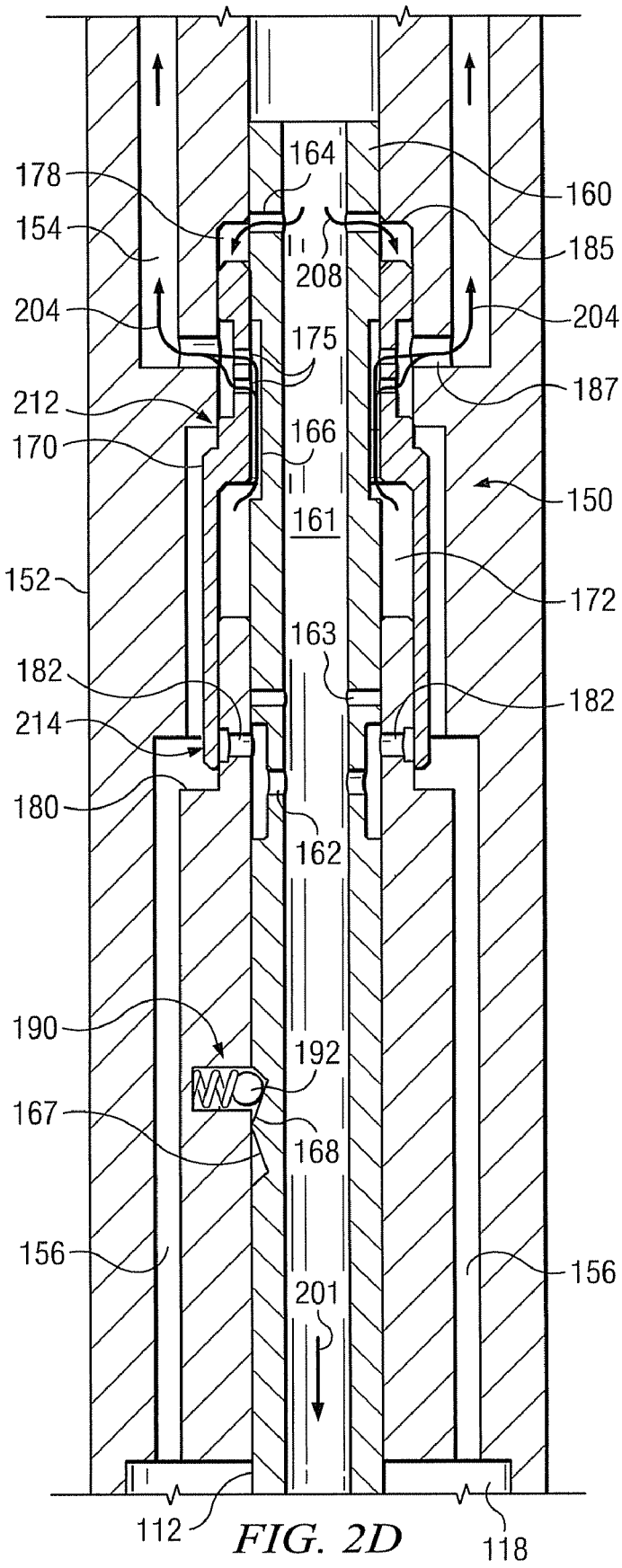

In FIG. 2C the pilot spool 160 is in its second position while the main spool 170 remains in its first position. In this intermediate valve state, the pilot spool 160 continues to be hydraulically urged downwards (holding it in its second position). Movement of the pilot spool from its first position to its second position now enables actuation of the main spool 170 (and therefore of the valve 150). In the exemplary embodiment shown, main spool 170 and shoulders 180 and 185 form first and second annular chambers 172 and 178 with the pilot spool 160. When the pilot spool 160 is in its second position, high pressure fluid begins to enter annular chamber 178 via port 164 (as depicted at 208) and urge the main spool 170 downwards towards shoulder 180. As depicted on FIG. 2D, hydraulic fluid in chamber 172 is connected with fluid outlet port 154 (and return line 104) via key cut 166 and ports 175 and 187 as indicated by arrow 204. In FIG. 2D, the main spool 170 is in an intermediate state between its first and second positions. In this intermediate state, port 156 (to the housing chamber 118) is isolated from both (i) high pressure hydraulic fluid in bore 161 as indicated at 214 and (ii) return port 154 as indicated at 212. However, it will be understood that the valve 150 is not hydraulically locked since high pressure fluid is free to enter chamber 178 via port 164 and urge main spool 170 to its second position (as depicted on FIG. 2E).

Figure 2E:
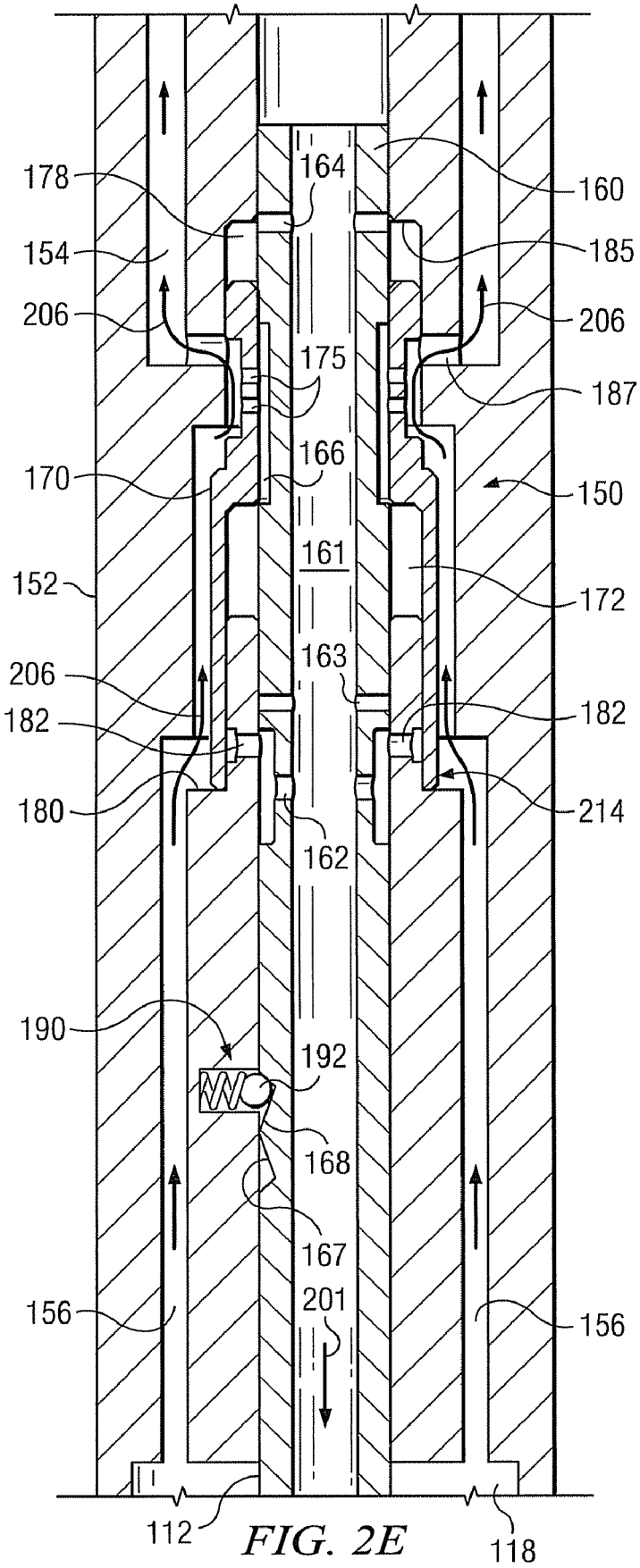

In FIG. 2E, valve 150 is in the second state, with both pilot spool 160 and the main spool 170 in their respective second positions. In this state, return port 154 is in fluid communication with housing chamber 118 via port 156 as indicated by arrows 206. The high-pressure fluid in bore 161 remains in fluid communication with piston chamber 124. A pressure imbalance is formed across flange 122 that urges the flange 122 and piston 120 upwards, thereby retracting the piston 120 into pump body 110. Piston 120 continues to retract until it contacts upper stop 114.

Figure 2F:
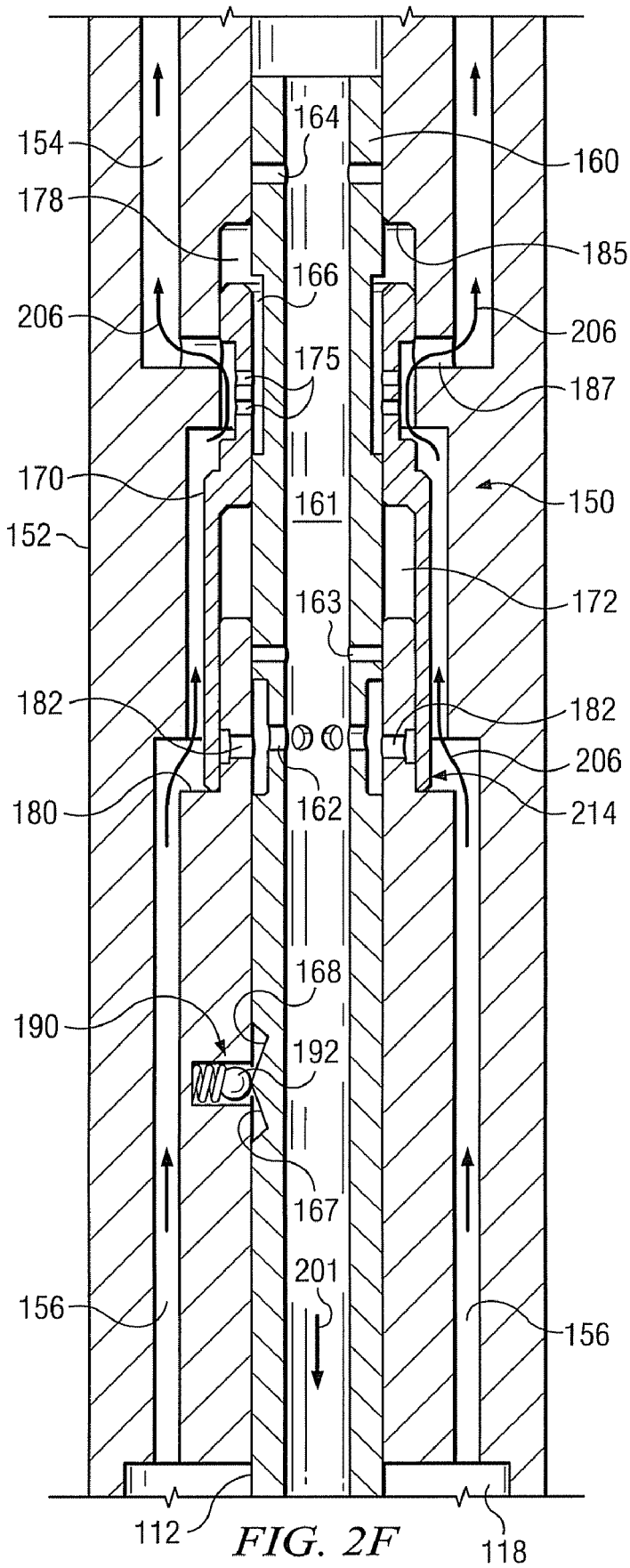

As flange 34 contacts upper stop 114, the retracting movement of piston 120 causes pilot spool 160 to move upward with the piston 120. Upward movement of the pilot spool 160 releases detent mechanism 190 thereby allowing the pilot spool 160 to move upward with the piston 120. FIG. 2F depicts the pilot spool 160 in an intermediate state (axially located between its first and second positions) with the detent ball 192 between the second and first grooves 168 and 167. The pilot spool 160 continues to be hydraulically urged upward (with the piston 120) so that the detent ball 192 engages the first groove 167 as depicted on FIG. 2G.

Figure 2G:
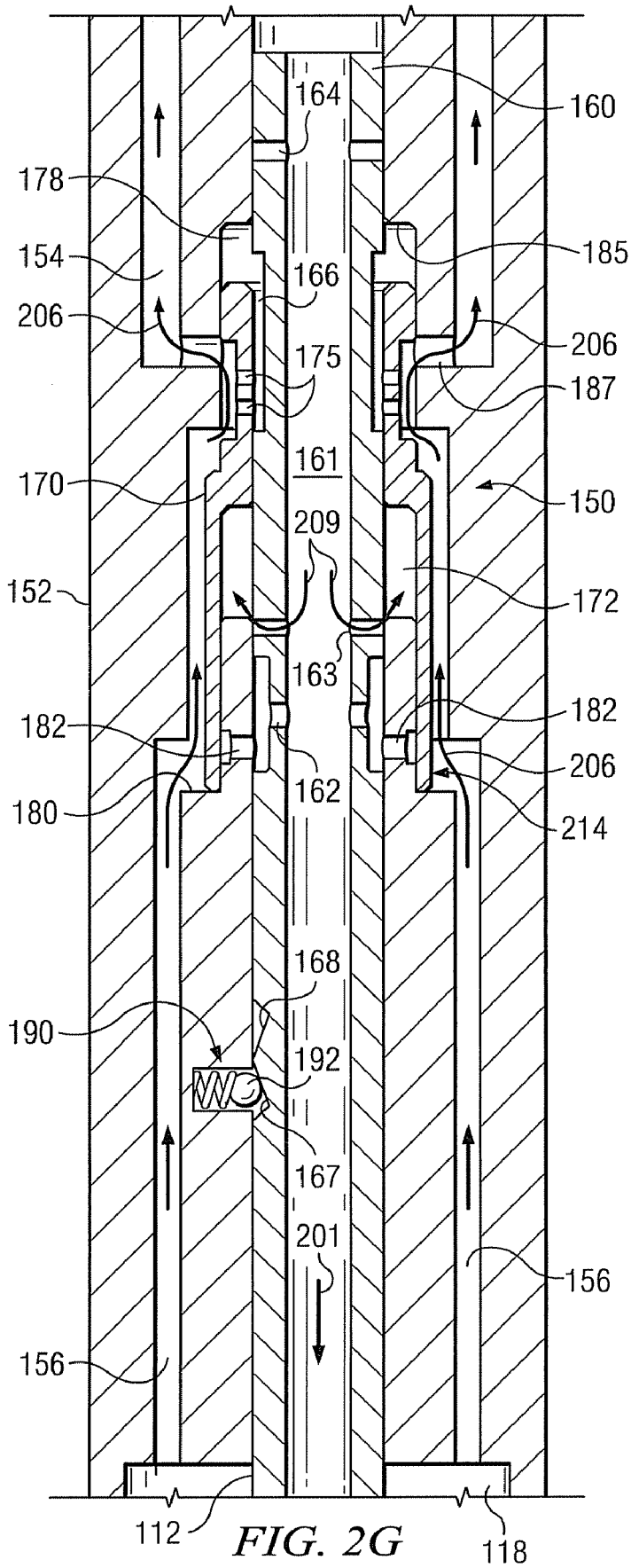
Figure 2H:
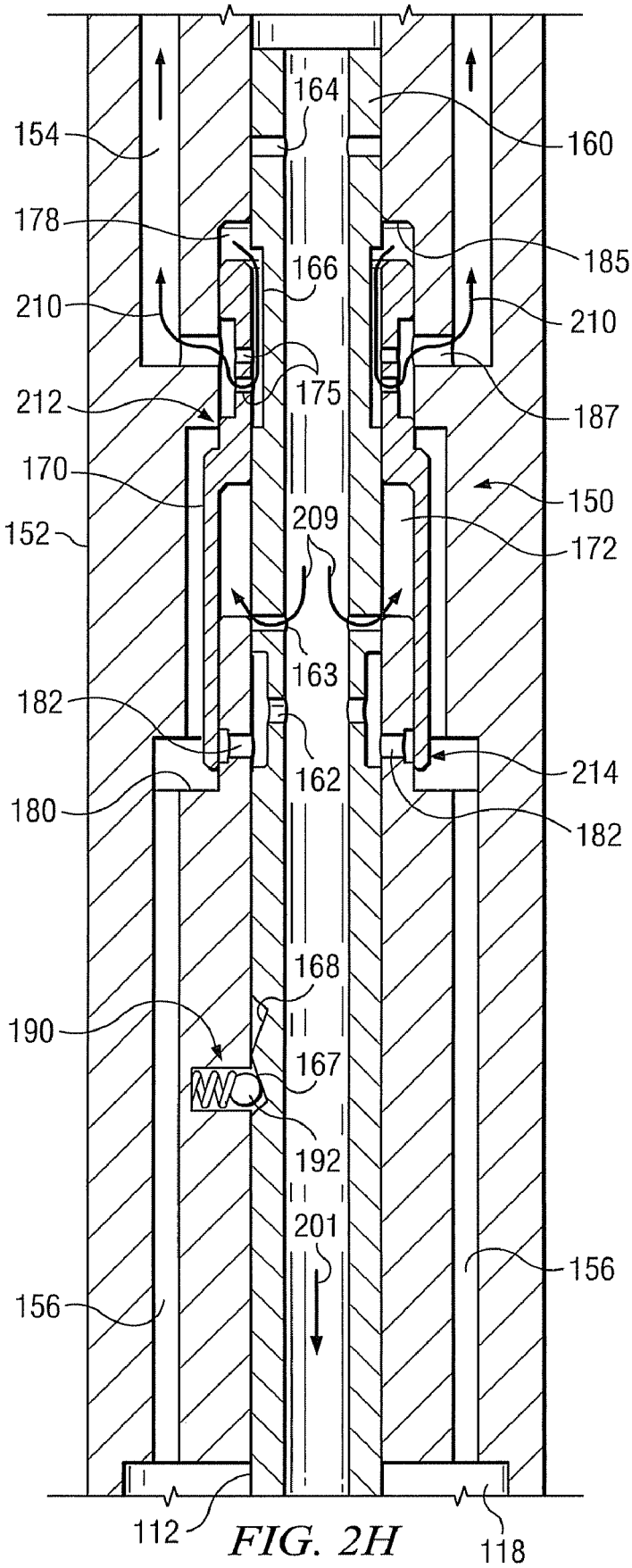

In FIG. 2G the pilot spool 160 is in its first position while the main spool 170 remains in its second position. In this intermediate valve state (described above with respect to FIG. 2C), the pilot spool 160 continues to be hydraulically urged upwards (holding it in its first position). Movement of the pilot spool 160 from its second position to its first position now enables hydraulic actuation of the main spool 170 (and therefore of the valve 150). When the pilot spool 160 is in its first position, high pressure fluid begins to enter annular chamber 172 via port 163 (as depicted at 209) and urge main spool 170 upwards towards shoulder 185. As depicted on FIG. 2H, hydraulic fluid in chamber 178 is connected with fluid outlet port 154 (and return line 104) via key cut 166 and ports 175 and 187 as indicated by arrow 210. In FIG. 2H, the main spool 170 is in an intermediate state between its first and second positions. As described above with respect to FIG. 2D, port 156 (to the piston 120) is isolated from both (i) high pressure hydraulic fluid in bore 161 as indicated at 214 and (ii) return port 154 as indicated at 212 in this intermediate state. However, valve 150 is not hydraulically locked since high pressure fluid is free to enter chamber 172 via port 163 and urge the main spool 170 back towards its first position (as depicted on FIG. 2A). When the main spool 170 returns to its first position (FIG. 2A), pump valve 150 is again in the first state such that high pressure hydraulic fluid causes extension of the piston 120.

In the exemplary embodiment depicted on FIGS. 1 and 2, the main spool 170 is deployed substantially coaxially about the pilot spool 160. While this structure is preferred, especially for small diameter pumps (e.g., pumps having a diameter of less than or equal to about 2.5 inches), it will be understood that the invention is expressly not limited in this regard.

Moreover, in the exemplary embodiment depicted, pilot spool 160 and center feed 112 are of a unitary construction (i.e., formed from a single tubular member). The invention is, of course, not limited in this regard. The pilot spool 160 and the center feed 112 may alternatively include first and second tubular members joined, for example, via a conventional box and pin threaded connection. Valve housing 152 and pump body 110 are also depicted to be of a unitary construction. Again, the invention is not limited in these regards as the invention may include distinct valve housing and pump body members threadably connected with one another.

It will be understood that two-stage pump valve assemblies in accordance with the invention may be utilized in a wide variety of submersible pumps and non-submersible pumps, for example, including the pump assemblies configured as depicted on FIGS. 1, 2, 3, 4, 5, and 7 of the commonly assigned, co-pending '118 patent Publication. Submersible pumps utilizing pump valves as described herein may be tubing conveyed, wireline conveyed, or lowered into a wellbore using the fluid supply lines that are connected to the pump assembly. In certain embodiments, the fluid supply lines may be integrated into the tubing string and coupled to the pump assembly via a specially constructed landing nipple or other junction. The invention is not limited in any of these regards.

Submersible pumps in accordance with the invention may utilize any fluid as an operating (hydraulic) fluid. Submersible pumps may be operated with an operating fluid having a low viscosity so as to reduce pressure losses through the fluid supply lines. In certain embodiments, the operating fluid may be water, water combined with an anti-wear or anti-freezing additive, or other fluid having a viscosity of less than about 4 centipoise. Those of ordinary skill will readily recognize that pumping a fluid having a low viscosity may require the use of specially designed pumping systems.

In some embodiments, a pumping system for a low viscosity fluid may comprise two fluids separated by a barrier. Pressure generation and control functions may be accomplished using a higher viscosity fluid while power is transmitted to the submersible pump by a low viscosity fluid. A barrier such as a rubber membrane accumulator; immiscible fluids, or hydraulic intensifiers may separate the two fluids and allow for efficient transfer of pressure between the fluids.

Fluid intensifiers operate to transform flow rate and pressure within the hydraulic system in order to maximize pressure and minimize flow rate so as to reduce loss. Intensifiers may be used within the high viscosity system with the main hydraulic pump. For example, if a high viscosity system can produce fluid at 2500 psi, a two-to-one intensifier may be used to increase pressure within the low viscosity system to 5000 psi while reducing the flow rate by a factor of two. A similar, but reversed, arrangement may be used near the pump to increase flow rates to the extend side of the pump cylinder so that the pump operates faster but at lower pressures.

In some embodiments, the pressure lines supplying fluids to a submersible pump may be sized so as to enhance the velocity of the fluid flowing through the line. Submersible pumps operate in an extend mode and a retract mode. More fluid per unit of travel is commonly consumed, and therefore a greater flow rate needed, in the low pressure mode where the piston is extending than in the high pressure mode where the piston is retracting. Therefore, in some embodiments the pressure line coupled to the extend side of the valve may have a larger diameter than the pressure line coupled to the retract side.

In some embodiments, a submersible pump may only have a single fluid line supplying fluid to the pump. Fluid leaving the pump may be routed into the production where it returns to the surface with the wellbore fluid. One such pump embodiment is depicted on FIG. 5 of the '118 patent Publication.

The interfacing surfaces in the pump valve may advantageously comprise hard materials and/or coatings such that a smooth, abrasion resistant surface is maintained in the various sealing areas. For example, with references to FIGS. 2A through 2H, pilot spool 160, main spool 170, and valve housing 152 (or an inner surface of the valve housing) may be fabricated from or coated with a hard material that is preferably harder than any of various debris that may be encountered in service. Examples of such materials include hard chrome, carbide, diamond, nitrided steel, carbided steel, high strength stainless steels, and non-metallic materials such as ceramic or ceramic coatings. Other materials of similar hardness may also be utilized. The invention is not limited in these regards.

Although the present invention and its advantages have been described in detail, it should be understood that various changes, substitutions and alternations can be made herein without departing from the spirit and scope of the invention as defined by the appended claims.

I claim:

1. A hydraulically actuated submersible pump comprising:

a pump body;

a piston configured to reciprocate between extended and retracted axial positions relative to the pump body;

a pump valve deployed in the pump body, the pump valve in fluid communication with a fluid supply, the pump valve having first and second states, the first state supplying fluid operable to move to the piston to the extended position and the second state supplying fluid operable to move the piston to the retracted position;

wherein the pump valve comprises first and second components configured to move between corresponding first and second positions in the pump body, the pump valve being in the first state when the first and second components are in the corresponding first positions, the pump valve being in the second state when the first and second components are in the corresponding second positions.

2. The pump of claim 1, wherein the first and second components are configured to be hydraulically actuated between the corresponding first and second positions.

3. The pump of claim 1, wherein the pump valve is configured such that the second component is hydraulically urged towards its first position when the first component is in its first position and the second component is hydraulically urged towards its second position when the first component is in its second position.

4. The pump of claim 1 further comprising:

a first stop mechanically coupled with the first component, wherein retraction of the piston to the retracted position engages the first stop and moves the first component to its first position; and a second stop mechanically coupled with the first component, wherein extension of the piston to the extended position engages the second stop and moves the first component to its second position.

5. The pump of claim 1, wherein the first and second components are deployed coaxially with one another and the pump body.

6. A hydraulically actuated submersible pump comprising:

a pump body;

a piston configured to reciprocate between extended and retracted axial positions relative to the pump body;

a pilot spool deployed in the pump body, the pilot spool configured to be hydraulically actuated between corresponding first and second axial positions with respect to the pump body;

a main spool deployed in the pump body, the main spool configured to be hydraulically actuated between corresponding first and second axial positions with respect to the pump body; and a fluid supply port in fluid communication with the piston, the fluid operable to extend the piston when the pilot spool and the main spool are in their corresponding first axial positions, the fluid operable to retract the piston when the pilot spool and the main spool are in their corresponding second axial positions.

7. The pump of claim 6, further comprising:

an upper stop mechanically coupled with the pilot spool, wherein retraction of the piston to the retracted position engages the upper stop and moves the pilot spool to its first position; and a lower stop mechanically coupled with the pilot spool, wherein extension of the piston to the extended position engages the lower stop and moves the pilot spool to its second position.

8. The pump of claim 6, wherein:

the main spool is hydraulically urged towards its first position when the pilot spool is in its first position; and the main spool is hydraulically urged towards the second position when the pilot spool is in the second position.

9. The pump of claim 6, wherein the pilot spool comprises a through bore providing a first fluid passageway between the fluid supply port and the piston.

10. The pump of claim 9, wherein the pilot spool comprises:

a first radial port connecting the through bore with a first annular chamber when the pilot spool is in its first position, high pressure fluid in the first annular chamber operative to urge the main spool towards its first position; and a second radial port connecting the through bore with a second annular chamber when the pilot spool is in its second position, high pressure fluid in the second annular chamber operative to urge the main spool towards its second position.

11. The pump of claim 9, wherein the pilot spool comprises a radial port providing a second fluid passageway between the through bore and the piston when the main spool is in its first position.

12. The pump of claim 11, wherein actuation of the main spool to its second position closes the second fluid passageway and opens a third fluid passageway between the piston and a fluid return port.

13. The pump of claim 6, wherein the main spool is deployed radially between and substantially coaxial with the pump body and the pilot spool.

14. A hydraulically actuated submersible pump comprising:

a pump body;

a piston configured to reciprocate relative to the pump body between extended and retracted axial positions;

a pilot spool deployed in the pump body, the pilot spool configured move between corresponding first and second axial positions with respect to the pump body;

an upper stop mechanically coupled with the pilot spool, wherein retraction of the piston to the retracted position engages the upper stop and moves the pilot spool to its first position;

a lower stop mechanically coupled with the pilot spool, wherein extension of the piston to the extended position engages the lower stop and moves the pilot spool to its second position;

a main spool deployed radially between and substantially coaxial with the pump body and the pilot spool, the main spool configured to be hydraulically actuated between corresponding first and second axial positions with respect to the pump body such that the main spool is hydraulically urged towards its first position when the pilot spool is in its first position and the main spool is hydraulically urged towards its second position when the pilot spool is in its second position; and a fluid supply port in fluid communication with the piston, the fluid operable to extend the piston when the pilot spool and the main spool are in their corresponding first axial positions, the fluid operable to retract the piston when the pilot spool and the main spool are in their corresponding second axial positions.

15. The pump of claim 14, wherein the pilot spool comprises a through bore providing a first fluid passageway between the fluid supply and the piston.

16. The pump of claim 15, wherein the pilot spool comprises:

a first radial port connecting the through bore with a first annular chamber when the pilot spool is in its first axial position, high pressure fluid in the first annular chamber operative to urge the main spool towards its first axial position; and a second radial port connecting the through bore with a second annular chamber when the pilot spool is in its second axial position, high pressure fluid in the second annular chamber operative to urge the main spool towards its second axial position.

17. The pump of claim 15, wherein the pilot spool comprises a radial port providing a second fluid passageway between the through bore and the piston when the main spool is in its first axial position.

18. The pump of claim 17, wherein actuation of the main spool to its second axial position closes the second fluid passageway and opens a third fluid passageway between the piston and a fluid return port.

19. The pump of claim 15, wherein the pilot spool comprises:

a first radial port connecting the through bore with a first annular chamber when the pilot spool is in its first axial position, high pressure fluid in the first annular chamber operative to urge the main spool towards its first axial position;

a second radial port connecting the through bore with a second annular chamber when the pilot spool is in its second axial position, high pressure fluid in the second annular chamber operative to urge the main spool towards its second axial position; and a third radial port providing a second fluid passageway between the through bore and the piston when the main spool is in its axial first position;

wherein actuation of the main spool to its second axial position closes the second fluid passageway and opens a third fluid passageway between the piston and a fluid return port.

* * * * *